United States Patent [19]

Head

[11] Patent Number: 4,834,457

[45] Date of Patent: May 30, 1989

[54] UPPER TORSO SUPPORT

[76] Inventor: Henry O. Head, Camp Soaring Hawk, Pioneer Trail, Purdy, Mo.

[21] Appl. No.: 90,535

[22] Filed: Aug. 28, 1987

[51] Int. Cl.[4] ..... A47C 7/54

[52] U.S. Cl. ..... 297/411; 248/118; 297/412,414,416

[58] Field of Search ..... 297/400, 402, 411, 412, 297/422, 414, 415, DIG. 10, 416; 5/431, 432, 445; 248/118

[56] References Cited

U.S. PATENT DOCUMENTS

| | | | |
|---|---|---|---|
| 525,766 | 9/1894 | Kirby | 297/411 |
| 1,255,539 | 2/1918 | Kuderer | 297/417 X |
| 2,667,913 | 2/1954 | Dustin | 297/414 X |
| 3,063,752 | 11/1962 | Moore | 297/411 |
| 3,596,298 | 8/1971 | Durst, Jr. | 297/DIG. 10 X |
| 3,787,089 | 1/1974 | Wrethander | 297/DIG. 10 X |
| 4,565,409 | 1/1986 | Hollonbeek et al. | 297/414 X |

FOREIGN PATENT DOCUMENTS

| | | | |
|---|---|---|---|
| 14752 | of 1906 | United Kingdom | 5/431 |

*Primary Examiner*—Peter R. Brown
*Attorney, Agent, or Firm*—Richard C. Litman

[57] ABSTRACT

Two horizontally disposed members are fastened into orifices located along the longitudinal axis of a vertical brace component. Each of the pair of horizontally disposed members are wrapped in a cushion material sufficient to enlarge the diameters of the horizontally disposed members and to form thereby an armpit rest. The horizontally disposed members are attached and detached from a plurality of holes in the vertical brace component, the holes being disposed upperwardly and downwardly along the longitudinal axis of the vertical space component.

1 Claim, 2 Drawing Sheets

UPPER TORSO SUPPORT

FIELD OF INVENTION

This invention relates to devices for reducing strain on the lower back by supporting the upper torso.

BACKGROUND OF THE INVENTION

This invention relates to a device for suspending the upper part of the torso above a seat, chair or such other support as a person may be seated on. The purpose of this elevated support for the upper torso is to allow the spinal column to stretch out, for reasons of comfort and health.

This device further relates to a construction for maintaining proper posture while in a seated position such that the supportive function continues even while the arms, neck and head of the individual may be moving.

The need for such a device is substantial given the incidence of lower back problems and pain to which people living in modern industrial societies are prone. Backaches and such problems result from many factors, but often people who sit or drive are especially vunerable to such lower back pain.

Reasons for this pain are again many and varied, but in general back problems result from the spinal column, the verterbrae compacting, settling. This compaction to the spinal column can occur from over-exertion, from age or general physical condition or from maintaining a seated position for too long a time, or any combination of these factors.

Whatever the reasons, however, the incidence of lower back problems in modern-day people is one of the main sources of physical discomfort. This discomfort, again, seems targeted at people who do a great deal of sitting, such as drivers. The function of and purpose of this device is to provide an apparatus allowing the user to have relative freedom of motion while at the same time relieve pressure and weight on the spinal column with the result that the spinal column may be stretched out.

The benefits of this relief from weight and pressure on the spinal column is a reduced incidence of verterbrae compression with the resulting reduction in pain and discomfort.

A further object of this invention is to provide a device that is simple in construction and operation, easily portable, having few components that provides the needed lifting of the torso, providing support for the torso for the relief of weight of the spinal column.

DESCRIPTION OF THE PRIOR ART

Various prior art back support devices and the such as well as their apparatuses and the method of their constructrion in general are known and are found to be examplary of the U.S. prior art. They are:

| U.S. Pat. No. | Inventor |
|---|---|
| 1,722,205 | Freud |
| 2,255,464 | Hall |
| 3,570,011 | Naig |
| 3,612,605 | Posey |
| 3,191,599 | Kendell |
| 2,851,033 | Posey |

U.S. Pat. No. 1,722,205 to Freud discloses a back support made up of a strap mechanism and adjustable rests or crutch members. The strap mechanism is fixed across the chest and abodmen of the wearer. The adjustable arms are positioned under the armpits of the wearer and provide support to the spine. This device is designed for use while sitting or standing and without restraining the movement of the wearer and provides support to the spine. This device is limited in that the user must wear the mechanism.

U.S. Pat. No. 2,255,464 to Hall discloses a support for the backbone or spinal column of the human body. This particular device is directed but not limited for use while driving. Similar to the Freud invention, the Hall device requires a strap mechanism. However, unlike the Freud device, the Hall invention requires a hanger and hook type arrangement to provide support. The disadvantage of this device is that the user must wear a harness, and a hook member must be available for use.

U.S. Pat. No. 3,570,011 to Naig discloses a back support in which an elongated rigid member including spaced element embrace the wearer's back. A pair of end portions flared outwardly away from the wearer's back are connected by straps to the wearer's chest, ankles and feet. The elongated member is secured to the wearer's waist by means of a belt. This device is designed but not limited to giving support to the wearer while in a stooped position. The disadvantage of the Naig invention is that the wearer is confined to a standing or stooped position while in use.

U.S. Pat. No. 3,612,605 to Posey discloses a device for restraining a patient in a chair. It teaches a belt wrapped around the midriff of the patient and releasably secured behind the back of the chair, and a pair of straps secured to the belt in front of the patient, over his shoulder and down behind the back of the chair. The straps are releasably secured to the belt at the back of the chair. The inventor claims a restraining device and adds no provisions for spinal support.

U.S. Pat. No. 3,191,599 to Kendell discloses another restraining device. This particular device is adaptable to most positions but does not offer spinal support.

U.S. Pat. No. 2,851,033 to Posey discloses a supporting device which consists of a bib for placement over the front of the person's torso. Preferably, the bib has a three strap method for support. Again, this device does claim a means of support, but the wearer must be in a horizontal seat with a vertical back and the wearer is retrained by the required harness.

These patents or known prior uses teach and disclose various types of back supports and restraining devices of sorts and of various manufactures and the such. However, none of them taken singularly or in combination disclose the specific details of the combination of the present device, nor does prior art teach or disclose a simple, portable device with an economy of parts that allows the user maximum freedom while providing the benefits of supporting both the spinal column and lifting the torso.

SUMMARY OF THE INVENTION

An object, advantage and feature of the device is to provide a novel device that is safe and efficient in use and lends itself to the support of the spinal column while a person is in a seated position. In particular, this device provides a construction whereby the upper part of the body may be partially suspended above a seat with the result that pressure and weight are reduced on the spinal column.

Another object of this invention is directed further to a spinal support device which has capability of being attached to and used as a back support to any seat not having a backrest.

Another object of this invention is to provide a novel and improved construction of a spinal back support, to provide for adjustment in height such that people of differing build may use the device easily and conveniently.

A still further object of the invention is to provide an adjustable upper torso support adapted to be used with a raised vertical seatback and which may be easily, but firmly attached thereto.

These together with other objects and advantages of the invention reside in the details of the process and the operation thereof, and are more fully described hereinafter and claimed. References are made to drawings forming a part hereof, wherein like numerals refer to like parts throughout.

DESCRIPTION OF THE PREFERRED EMBODIMENT

Figure 1:
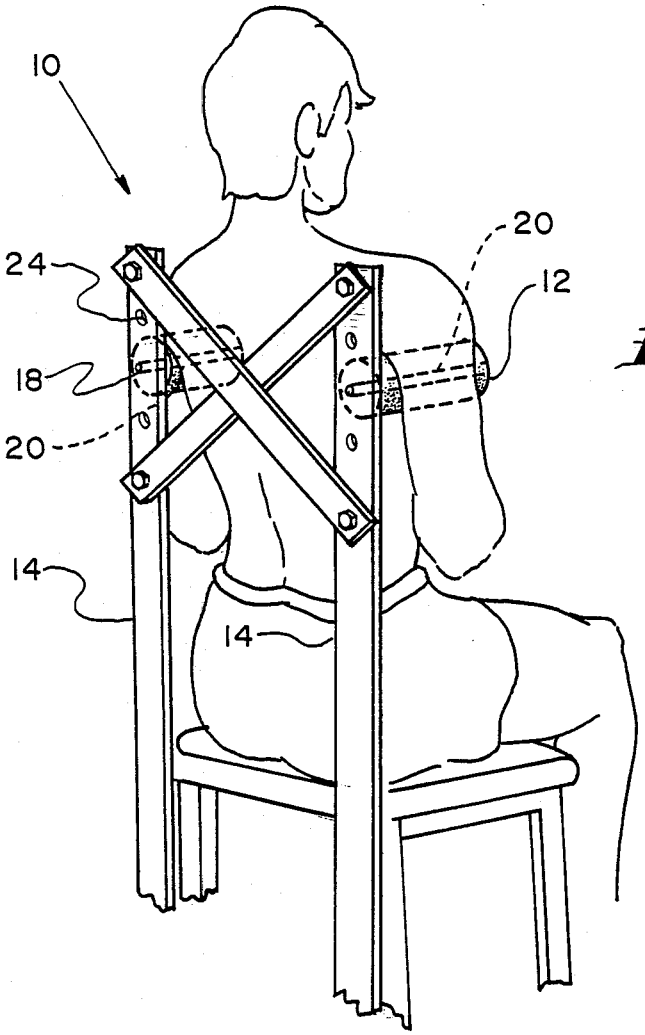
FIG. 1 is a perspective view of the upper torso support illustrating a typical construction and use thereof according to a preferred embodiment and best mode of use of the present invention.

Referring now to FIGS. 1 through 5 there is shown in FIG. 1 a typical embodiment of the device 10. Specifically, the device 10 is constructed of two horizontally disposed members 20, which may be bolts or dowels or other suitable elements that are mechanically fastened by connector(s) 18 to vertical brace member(s) 14.

Vertical brace member 14 is structurally braced by diagonal cross member(s) 16. The lower edge of vertical brace members extending longitudinally downward along the rear surfaces of a seat until the lower edge comes into contact with the floor. The vertical brace members are held in a separate position, laterally stiffened by the intermediary function of diagonal cross braces 16.

Horizontally disposed element 20 can be detached from the vertical brace 14 by uncoupling single connector 18 and re-attaching the horizontally disposed element 20 upward or downward along the longitudinal axis of the vertical brace member 14. The horizontally disposed elements 20 being attahed or detached from a plurality of holes 24, spaced upward and downward along the longitudinal axis of vertical brace component 14.

Figure 2:
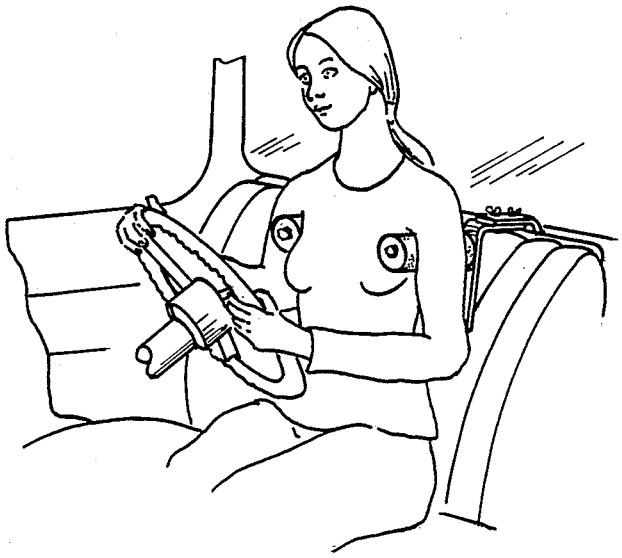
FIG. 2 illustrates an alternate embodiment of the device in use within an automobile, indicating the adaptability of the device to use in transit.
Figure 3:
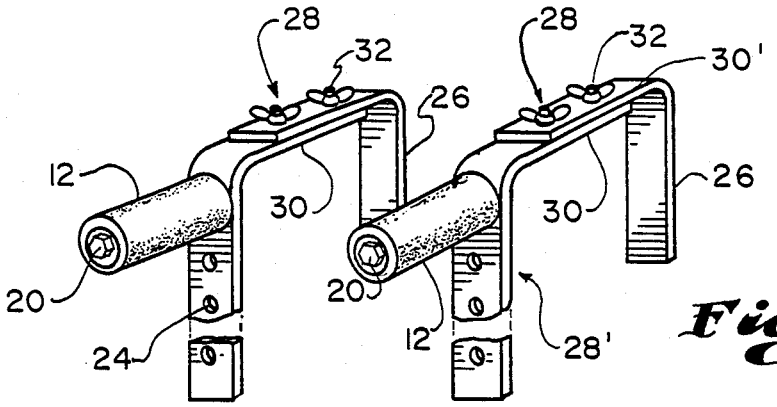
FIG. 3 is a perspective view of the device as shown in FIG. 2 illustrating the various elements of the upper structure of the device.

The horizontally disposed members 20 are wrapped or padded by a cushion material 12, which acts to enlarge the surface area of the horizontally disposed members 20 and to soften the effect to using these horizonatlly disposed elements as armpit rests as shown in FIGS. 1, 2 and 3.

Figure 5:
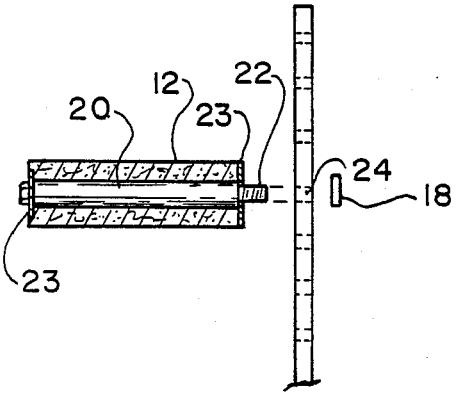
FIG. 5 is a cross-sectional view illustrating the device fastening means that are threaded into a vertical seatback support structure.
Figure 4:
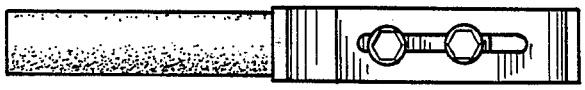
FIG. 4 is a top view of the upper torso support device shown in FIG. 3 and illustrates one type of attachment.

Horizontally disposed member 20 extends as a projection 22 rearward from padding or cushon material 12 as illustrated in FIG. 5. This projection enabling member 20 to settle into hole 24 provided in the planar surface of vertical brace component 14.

Screw threaded projection 22 is defined mechanically by separator 23 affixed to both operable ends of member 20, these separators being washers or other components suitable for the function of containing cushion material 12 and allowing an unfettered entrance of the horizontally disposed members 20 into their corresponding holes 24 on the vertical brace component 14, horizontally disposed members 20 are fastened by projection 22 which is inserted into a compound bracket 28 and secured by connector 18.

Referring to FIG. 3, the compound bracket 28 being assembled to two L-type components each having a vertical planar surface 26 and a horizontal or lateral planar surface 30 such that the compound bracket 28 is formed by the sliding of elements 30 and 30' together substantially as shown.

A plurality of holes 24 are provided in each horizontal planar surface 30 and 30' through which wingnuts 32 or other suitable fasteners are secured, thereby affixing horizonal planar surfaces 30 and 30' one the other, forming thereby compound bracket 28.

Bracket 28 is adjusted by selectively sliding L bracket 28 and 28' together and fastening them as indicated to the contours and size of any suitable upright support. Thus horizontally disposed member 20 may be portably relocated from house to car and the bracket 28 adjusted to fit a wide variety of seatbacks.

Figure 6:
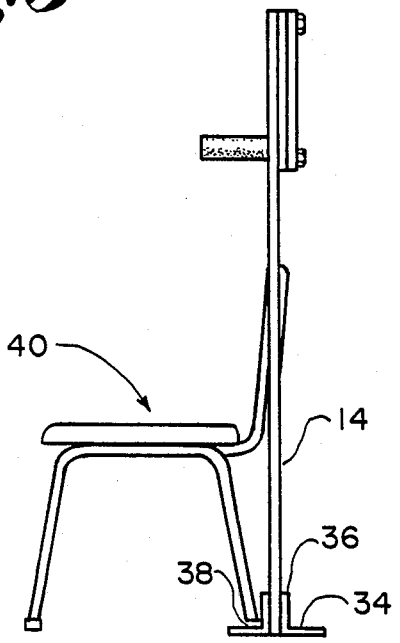
FIG. 6 is a side view illustrating the device as an alternative embodiment as rigidly affixed to a vertical seatback support structure.
Figure 7:
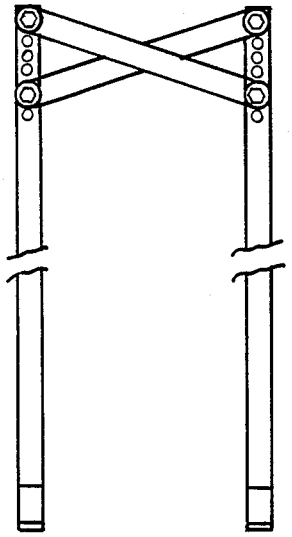
FIG. 7 illustrates a front view of the device as shown in FIG. 1.

FIG. 6 shows the vertical brace component extending to the floor, being secured thereto by footing 34. Footing 34 has a concave slotted opening 36 to accept the lower edge of vertical brace components 14.

The foregoing is considered as illustrastive only of the principles of the invention. Further, since numerous modifications and changes will readily occur to those skilled in the art, it is not desired to limit the invention to the exact construction and operation disclosed herein. Accordingly, all suitable modifications and equivalents which may be resorted to, fall within the scope of the invention.

What is claimed is:

1. An upper torso support device in combination with a seating device having rear legs and adapted to rest upon a supporting surface comprising:

a pair of cylindrical armpit rest means for supporting said upper torso;

a pair of vertical means for supporting said cylindrical armpit rest means;

a plurality of orifices in said vertical means;

said pair of cylindrical armpit rest means including horizontally disposed screw threaded members extending therethrough, said screw thread members insertable through selected ones of said orifices in said vertical means; whereby the height of said cylindrical armpit rest means is adjustable;

said vertical means each including a lowermost substantially horizontally footing adapted to respectively rest on the supporting surface and in turn to be retained thereupon with the seating device rear legs resting upon said footings:

means for cross-bracing said vertical means;

said armpit rest means each being of a configuration of a cantilever with respect to said vertical means and including separator means adjacent opposite ends of said horizontally disposed screw threaded members for containing cushion material therebetween; and screw threaded single connector means for fastening each of said horizontally disposed screw threaded members to said vertical means.

* * * * *